United States Patent [19]

DerMott

[11] 4,319,526

[45] Mar. 16, 1982

[54] EXPLOSIVE SAFE-ARMING SYSTEM FOR PERFORATING GUNS

[75] Inventor: Raymond W. DerMott, Houston, Tex.

[73] Assignee: Schlumberger Technology Corp., Houston, Tex.

[21] Appl. No.: 103,997

[22] Filed: Dec. 17, 1979

[51] Int. Cl.[3] ..... F42C 15/34

[52] U.S. Cl. ..... 102/310; 102/202.1; 166/55.1; 175/4.6

[58] Field of Search ..... 102/280, 28 R, 27 R, 102/27 F, 21.6, 20; 175/4.56; 166/55.1

[56] References Cited

U.S. PATENT DOCUMENTS

| | | | |
|---|---|---|---|
| 3,002,456 | 10/1961 | Savitt | 102/222 |
| 3,182,592 | 5/1965 | Barocca | 102/312 |
| 3,212,439 | 10/1965 | Reyne | 102/202.14 |
| 3,311,058 | 3/1967 | Fohrmann et al. | 102/254 |
| 3,352,237 | 11/1967 | Turquois | 102/202.11 |
| 3,547,033 | 12/1970 | Gawlick et al. | 102/254 |
| 3,719,144 | 3/1973 | Tlam | 102/202.14 |
| 4,011,815 | 3/1977 | Garcia | 175/4.55 X |
| 4,172,421 | 10/1979 | Regalbuto | 102/318 |

*Primary Examiner*—David H. Brown

[57] ABSTRACT

An explosive safe-arming system for use in a perforating gun for oil and gas well wireline operation is disclosed, wherein a donor detonating explosive is used which includes two encased elements. The first element is fixedly secured within the perforating gun, and the second element is removably mounted within the perforating gun.

16 Claims, 6 Drawing Figures

FIG. 1
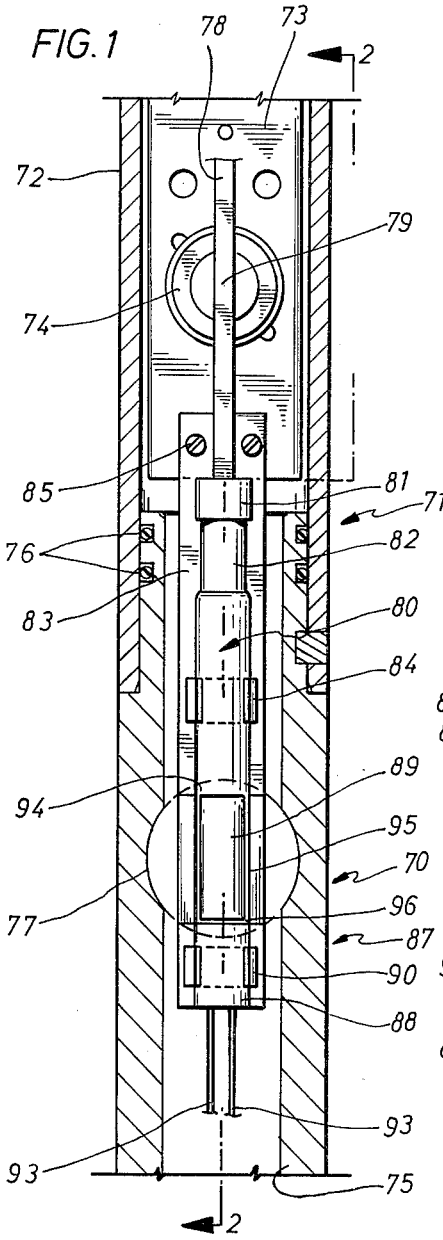
FIG. 2
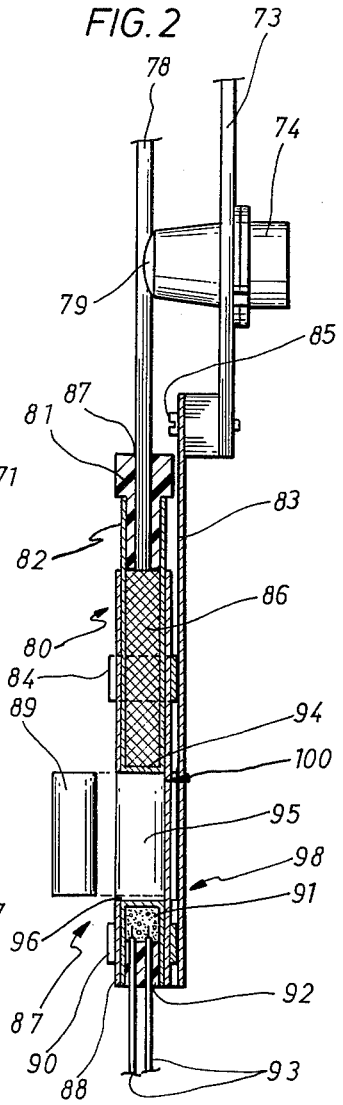
FIG. 3
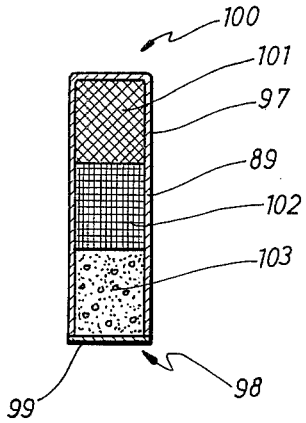
FIG. 6
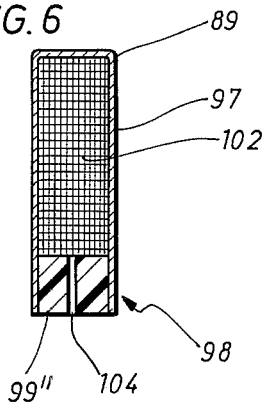
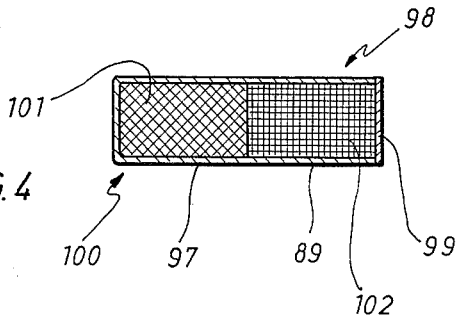
FIG. 4
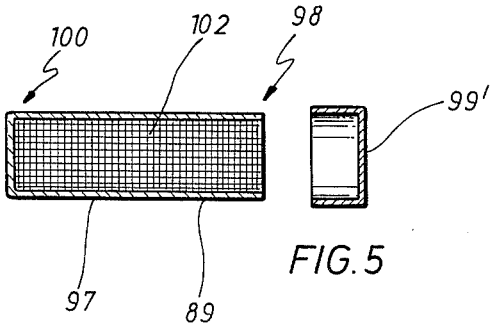
FIG. 5

EXPLOSIVE SAFE-ARMING SYSTEM FOR PERFORATING GUNS

BACKGROUND OF THE INVENTION

1. Field of the Invention

The invention relates to an explosive safe-arming system for use in a perforating gun for oil and gas well wireline operations.

2. Description of the Prior Art

The perforating guns most commonly used in present-day wireline service operations are typically comprised of an elongated fluid-tight body or so-called "enclosed carrier" which houses one or more shaped explosive charges and the necessary accessories for selectively detonating these charges from the surface. One typical style of such carriers employs an expendable, thin-walled steel tube which has reusable upper and lower heads fluidly sealed in each end of the tubing. Other common types of enclosed carriers have heavy, explosion-resistant walls so that the carrier can be retrieved. This latter type of carrier is ordinarily provided with a removable head or an access port to accommodate the installation of the shaped charges and their associated detonating components.

Those skilled in the art will recognize, of course, that a typical shaped charge perforating gun ordinarily poses no serious hazards so long as there is either a spatial interruption in the explosive detonating train for the gun or the electrical wiring to the detonating train is suitably disconnected. Thus, the usual practice is to substantially complete the assembly of a given gun, but in some approved manner, leave the gun in a relatively safe or "disarmed" condition until just before it is to be operated. Another such safe-handling technique is simply not to install the electrically-initiated detonator for a given gun until it is being prepared for immediate operation.

It will be appreciated, however, that such typical safe-handling techniques are not entirely satisfactory. For example, when a perforating gun is disarmed by not installing the entire electrically-initiated detonator, there are still safety and logistic problems involved in handling the entire removed detonator. Moreover, where last minute electrical connections or other detailed preparations are required to ready the perforator for firing, these final steps often must be made under severe environmental conditions which can easily contribute to either a malfunction or even an unsafe or improper operation. Accordingly, it is most desirable to not have any electrical connections made in the field, but rather at the factory or in a field office.

One approach to solving the general problem of providing a safety detonator may be found in U.S. Pat. No. 3,719,144, issued on May 6, 1973, to Elvin W. Tlam. This patent discloses providing a detonator comprising a first detonator unit containing a liquid explosive mix component and adapted to fit into a conventional receptor detonating explosive, or booster, and a second detonator unit which is a syringe filled with a second liquid explosive mix component. The detonator is armed by inserting the syringe through an end opening of the first detonator unit, whereby the liquid mix component of the syringe is combined with the liquid mix component of the first detonator unit to form a complete liquid explosive. In operation, upon firing of a conventional squib, the liquid explosive formed by the two components is detonated, which in turn causes the detonation of the receptor detonating explosive, or booster. In the event that the squib would be accidentally detonated prior to the addition of the second liquid explosive mix component, the explosive force would not be sufficient to detonate the booster.

The two part detonator unit of the Tlam patent has disadvantages. The liquid explosive mix components of the Tlam detonator can only be used under low temperature conditions, on the order of 200° F. or below. Additionally, the liquid explosive mix components, which are not only corrosive and toxic, are somewhat unstable, and thus hazardous to handle. Once the Tlam detonator is activated and armed by injection of the second liquid explosive mix component, the detonator may not be disarmed. This fact would cause operational disadvantages if the Tlam detonator were to be used in a perforating gun for oil and gas well applications because it is common practice to arm a plurality of perforating guns, wherein an additional number of guns are provided in the event of a misfire of one of the perforating guns. Proper firing of the desired number of perforating guns results in the retrieval from the well bore of the extra previously armed perforating guns, which could not then readily be disarmed if the Tlam detonator were used.

Furthermore, since it is often desirable to mount a plurality of perforating guns in series, wherein each of the perforating guns are in end-to-end relationship, it would be extremely impractical to gain access to the first detonator units with the various syringes, absent arming each individual detonator with the syringe, and then connecting the plurality of perforating guns in series. Additionally, a major disadvantage associated with the detonator of the Tlam patent is that if in the event well fluid present in the well bore enters the perforating gun, the presence of such fluid within the perforating gun transforms it from a device which provides for a controlled explosive force from the shaped charges disposed in the perforating gun, into an uncontrolled explosive device, a latent bomb. If such fluid were to enter a perforating gun provided with the Tlam detonator, there can be no provision for desensitization, or disarming, of the detonator due to the presence of the well fluid in the perforating gun.

Finally, the detonator of the Tlam patent cannot be used with conventional well bore perforators having an enclosed carrier with an access port disposed in the outer surface of the carrier, since the syringe unit of Tlam must be inserted through the end of the detonator rather than through the outer circumferential surface of the detonator. Thus, conventional perforating guns would have to be modified to use the Tlam detonator.

Accordingly, prior to development of the present invention there has been no safe-arming system for use with perforating guns which: is readily adaptable for use with existing perforating guns which are connected in an end-to-end relationship in series; does not require last minute electrical connections to be made in the field to ready the perforator for firing; does not necessitate the use of corrosive, toxic, and unstable liquid explosive components; may be used over a wide range of operating temperatures; may be readily, selectively armed and disarmed; does not require the installation of the entire electrically-initiated detonator in the perforating gun at the time the perforating gun is being prepared for immediate operation; is inexpensive to manufacture; and efficient and easy to use. Therefore, the art has sought an efficient, safe, and inexpensive safe-arming system for perforating guns, which can be used with conventional perforating guns, does not require the use of liquid explosive components, and can be readily, selectively armed and disarmed.

SUMMARY OF THE INVENTION

In accordance with the invention, the foregoing benefits have been achieved through the present explosive safe-arming system. The safe-arming system for perforating guns of the present invention includes an improvement in a well-bore perforator having an enclosed carrier with an access port therein and explosive means in said carrier, which includes at least one shaped explosive charge, a receptor detonating explosive cooperatively arranged and adapted for detonating said shaped explosive charge, and a donor detonating explosive adapted for detonating said receptor explosive. The improvement comprises an explosive safe-arming system wherein said donor detonating explosive includes two encased elements, the first element being fixedly secured within the carrier, and the second element being removably mounted within the carrier and adapted to be inserted into the carrier through the access port into an operative relationship with the first element and the receptor detonating explosive.

A feature of the present invention is that the first element of the explosive safe-arming system contains a flame producing compound and the second element contains a flame actuated explosive compound. Additionally, the second element of the explosive safe-arming system may contain only a primary explosive compound, or a primary explosive compound and a secondary explosive compound.

An additional feature of the present invention is that the second element of the explosive safe-arming system has one of its ends closed by an insertable plug member having a pyrotechnic fuse wire disposed therein, whereby the fuse wire is in a flame transmitting relationship between the flame producing compound in the first element of the explosive safe-arming system and the flame actuated compound in the second element of the explosive safe-arming system. A further feature of the present invention is that the second element of the explosive safe-arming system is removably mounted within the carrier in a spaced relationship from the first element of the explosive safe-arming system, whereby upon entrance of fluid into the carrier, a fluid barrier is formed between the first and second elements and the flame produced by the first element of the safe-arming system will not be transmitted through the fluid barrier to the second element of the explosive safe-arming system.

Another additional feature of the present invention is that the second element of the explosive safe-arming system has an end in operative relationship with the first element of the explosive safe-arming system and said end is not completely sealed, whereby upon entrance of fluid into the carrier, the flame actuated explosive compound of the second element will be desensitized by the fluid and cannot be detonated.

The explosive safe-arming system of the present invention, when compared with previously proposed prior art safe-handling devices has the advantages of safety, ease of use and assembly, is inexpensive to manufacture and assemble, is readily adaptable for use with existing well bore perforators, may be readily, selectively armed and disarmed, and may be readily desensitized in the event fluid from the well bore enters the carrier.

BRIEF DESCRIPTION OF THE DRAWINGS

In the Drawings:

FIG. 1 is a cross-sectional view of a well bore perforator provided with the explosive safe-arming system of the present invention;

FIG. 2 is a partial cross-sectional view taken along line 2—2 of FIG. 1, wherein the carrier is not shown; and FIGS. 3–6 are cross-sectional views of various embodiments of one element of the explosive safe-arming system of the present invention.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In FIG. 1, an enlarged cross-sectional view is shown of the new and improved explosive safe-arming system 70 of the present invention in use with a conventional well bore perforator, or perforating gun, 71. As illustrated, perforator 71 includes a tubular housing, or enclosed carrier, 72 formed of a length of steel tubing and having its upper end fluidly sealed by a reusable head (not shown) suitably arranged to dependently support an elongated metal carrier strip 73 having enlarged openings arranged at spaced intervals there along for receiving a corresponding number of typical shaped explosive charges, one of which is shown at 74. Each shaped charge 74 is mounted on the carrier strip 73 and preferably faces toward a reduced-thickness wall portion (not shown) of housing 72. The lower end of the carrier housing 72 is closed by a reusable head 75 that is fluidly sealed within the carrier as by O-rings 76. Housing 72 is shown to include (in dotted lines) an access port 77, the purpose of which will be hereinafter described.

To controllably detonate the shaped charges 74, the perforator 71 has a charge-detonating train which includes a length of detonating cord 78 extending along the carrier strip 73, which is successively positioned in detonating proximity of each shaped charge 74 as at 79. Detonating cord 78 is operatively coupled to a conventional receptor detonating explosive, or booster, 80 via a sealing plug, or stopper, 81 disposed in one end of booster casing 82. Referring to FIGS. 1 and 2, it is seen that receptor detonating explosive, or booster, 80 is mounted upon a base member 83 by means of a clip member 84, and base member 83 is in turn fixedly secured to the carrier strip 73 by means of screws 85. Receptor detonating explosive, or booster, 80 is of conventional construction, and booster casing 82 is of a generally cylindrical cross-section, filled with a suitable secondary explosive material 86, such as that commonly referred to as RDX. The secondary explosive 86 requires an explosive force, rather than a mere flame to detonate it; and as seen in FIG. 2, the secondary explosive 86 is in an operative relationship with the portion of detonating cord 78 which passes through the passageway 87 of booster sealing member, or stopper, 81.

Still referring to FIGS. 1 and 2, the explosive safe-arming system 70 of the present invention will be described. At the lower end of base member 83, there is provided a donor detonating explosive 87 comprised of two encased elements 88 and 89. The first encased element 88 of the donor detonating explosive, or detonator, 87 is mounted upon base member 83 by clip member 90, whereby the first encased element 88 is fixedly secured within carrier 72. The first encased element 88 of donor detonating explosive 87 contains a flame producing compound 91, which may be any conventional match compound capable of being ignited by electrical current. The lower end of first encased element 88 of donor detonating explosive 87 is sealed by a sealing member, or rubber stopper, 92, through which pass suitable electrical wires 93 which ignite match compound 91 in a conventional manner. Stopper 92 insures that the flame producing compound 91 of the first encased element 88 of donor detonating explosive 87 will not leak out or become desensitized from atmospheric humidity during long-term storage.

It should be noted that the first encased element 88 of donor detonating explosive 87 is in a spaced relationship from the lower end 94 of booster 80. The importance of this feature will be hereinafter described.

Disposed between the lower end 94 of booster 80 and the first encased element 88 of donor detonating explosive 87 is the second encased element 89 of donor detonating explosive 87. The second encased element is removably mounted within carrier 72 and is adapted to be inserted into the carrier 72 through access port 77 into an operative relationship with the first encased element 88 and the receptor detonating explosive, or booster, 80. When disposed in carrier 72, the second encased element 89 is removably mounted on base member 83 in carrier 72 by retention means 95 which engages with the metallic casing of the second element 89. Preferably, retention means 95 is a magnetic cradle for receipt of the second encased element 89, as shown in dotted lines in FIG. 2. Of course, it should be readily understood that instead of magnetic retention means 95 for removably mounting the second encased element 89, a suitable clip member (not shown) could be utilized such as the clip members 84 and 90, used for mounting booster 80 and the first encased element 88. Thus, it is seen that via access port 77, the second encased element 89 of donor detonating explosive 87 of the explosive safe-arming system 70 of the present invention may be either disposed between booster 80 and the first encased element 88 within carrier 72; or via access port 77, the second encased element 89 may be removed from the carrier whereby the perforating gun 71 is disarmed, as will be hereinafter described.

As seen in FIGS. 1 and 2, when the second encased element 89 is disposed in retention means 85, there is a spaced relationship between the second element 89 and the first encased element 90 as shown at 96. This spaced relationship, or gap, 96 provides one aspect of the explosive safe-arming system 70. If undesired fluid from the well bore should enter carrier 72, the flame produced by the first element 88 upon ignition of the flame producing compound, or match compound 91 will not be transmitted through the fluid barrier formed in gap 96 to the second encased element 89 of donor detonating explosive 87. As previously described, the entrance of fluid into carrier 72 transforms perforating gun 71 from a device utilizing a controlled explosive force into an uncontrolled explosive device, akin to a bomb. Accordingly, it is of utmost important that if undesired fluid from the well bore enters carrier 72 that detonation of the second encased element 89, booster 80, detonating cord 78 and shaped charges 74 be prevented, and this is accomplished by the fluid barrier which is formed in gap 96.

Turning now to FIG. 3, one embodiment of the second encased element 89 of the donor detonating explosive 87 of the explosive safe-arming system 70 of the present invention will be described. Second element 89 is encased by a metallic jacket 97 which is of a general cylindrical cross-section and is preferably manufactured from thin steel. The lower end 98 of second element 89, which will be disposed adjacent the first element 88 of donor detonating explosive 87 may be sealed by a thin sealing member, or plastic plate, 99 which is secured to jacket 97 by any suitable adhesive. Alternatively, sealing member 99 could be formed by spraying a suitable plastic material upon lower end 98 of the second element 89. Prior to sealing the lower end 98 of the second element 89, the jacket is filled with a suitable explosive material. As shown in FIG. 3, second element 89 contains three types of compounds. The upper end 100 of jacket 97 of the second element 89, which upper end 100 will be in an abutting relationship with booster 80 as shown in FIG. 2, is filled with secondary explosive compound 101. Preferably, secondary explosive compound is the material known as RDX, which is also the same compound used for booster 80.

The second explosive compound in second element 89 is a primary explosive compound 102. Preferably, primary explosive compound 102 is lead azide, but may be any other suitable primary explosive compound. Lead azide 102 is flame or heat actuated, sensitive to shocks, and causes a strong explosive force upon detonation. The lower end 98 of second element 89 is filled with a flame producing compound 103, which preferably is the same match compound as flame producing compound 91 in the first element 88 of the donor detonating explosive 87.

In operation, when the second element 89 being disposed through access port 77 of carrier 72 into retention means 95, the perforating gun 71 and explosive safe-arming system 70 of the present invention is in an armed position. At an appropriate time, electrical current passes through wires 93 and ignites the flame producing compound 91 in the first element 88 of the donor detonating explosive 87. The flame produced by the ignition of flame producing compound 91 passes through the gap 96 between the first element 88 and second element 89, whereby the flame burns off and through sealing member 99 at the lower end 98 of the second element 89. The match compound 103 is thus ignited, which in turn detonates the flame actuated primary explosive compound, or lead azide, 102 disposed in the middle of second element 89. The explosive force generated by the lead azide 102 then detonates the secondary explosive, or RDX, 101 in second element 89. The explosive force generated by the detonation of the RDX 101 of second element 89 causes the detonation of booster 80, which in turn detonates the detonating cord 78 and shaped charges 74.

Were a leak to develop in carrier 72, whereby fluid from the well bore enters the carrier 72, such fluid would form a fluid barrier in gap 96, whereby the flame produced by the first element 88 will not be transmitted through gap 96 to the lower end 98 of the second element 89 of the donor detonating explosive 87, whereby the explosives contained in perforating gun 71 will not be detonated and discharged. When the detonation of certain shaped charges 74 is not desired, such as in situations when a plurality of perforating guns 71 are disposed in an end-to-end relationship in series and extra perforating guns 71 are provided to allow for possible misfires, upon removal of perforating gun 71 from the well bore, the perforating gun 71 may be readily selectively disarmed by removal of the second encased element 89 after opening access port 77 in carrier 72.

Turning now to FIG. 4 another embodiment of the second encased element 89 of donor detonating explosive 87 is shown. Like reference numerals will be used to describe like components of the second element shown and described in FIG. 3. In this embodiment, jacket 97 contains two explosive compounds. At the upper end 100 of the second element 89, jacket 97 is filled with a secondary explosive material 101, such as RDX. The lower end 98 of jacket 97 of the second element 89 is filled with a flame or heat actuated primary explosive compound 102, such as lead azide. In the embodiment of FIG. 4, the lower end 98 is also provided with a sealing member 99 as previously described. As in the embodiment shown and described in FIG. 3, upon ignition of the first element 88 of the donor detonating explosive 87, the flame is transmitted through gap 96, thus melting and passing through sealing member 99, which in turn detonates the primary explosive compound 102. The explosive force created by the detonation of the primary explosive 102 in turn detonates the RDX 101 thus detonating booster 80, as previously described.

Referring now to FIG. 5, another embodiment of the second element 89 of the donor detonating explosive 87 of the explosive safe-arming system 70 of the present invention is shown. Like reference numerals will also be used for like components previously shown and described in connection with FIGS. 3 and 4. In this embodiment, jacket 97 of the second element 89 is filled entirely with a primary explosive compound 102, such as lead azide. The lower end 98 of the second element 89 is closed by a sealing member 99' which may be a thin plastic cap which fits over the lower end 98 of the second element 89, and which is held in place by a conventional friction fit. In operation, upon ignition of the first element 88 of donor detonating explosive 87 of the explosive safe-arming system 70 of the present invention, the flame generated by the ignition of the first element 88 passes through the gap 96. As the flame melts through sealing member 99', it ignites the primary explosive compound 102. The explosive force generated by the detonation of the flame actuated primary explosive compound 102 is in turn transmitted to and detonates booster 80.

Turning now to FIG. 6, another embodiment of the second element 89 of the donor detonating explosive 87 of the explosive safe-arming system 70 of the present invention will be described. Once again, like reference numerals will be used to describe like components as were shown and described in connection with FIGS. 3–5. In the embodiment shown in FIG. 6, jacket 97 of the second element 89 is entirely filled with a flame or heat actuated primary explosive compound 102, such as lead azide. The lower end 98 of jacket 97 is sealed by a closure member 99'', which is a rubber plug member, or stopper, which is inserted in and tightly engages the interior surface of jacket 97. Passing through the plug member 99'' is a pyrotechnic fuse wire 104. In operation, upon ignition of the first encased element 88 of donor detonating explosive 87 of the explosive safe-arming system 70, the flame produced by the flame producing compound 91 passes through gap 96 and ignites the pyrotechnic fuse wire 104. The pyrotechnic fuse wire 104 in turn detonates the explosive compound 102 in jacket 97, which then generates an explosive force. The explosive force generated by the detonation of primary explosive compound 102 then detonates the secondary explosive compound 86, or RDX, in booster 80.

It should be understood that the types of explosive compounds contained in the jackets 97 of the embodiments of the second element 89 shown in FIGS. 3–6 could be modified, whereby, for example, the jacket 97 of the embodiments shown in FIGS. 5 and 6 could contain the flame producing match compound 103, the primary explosive compound 102, and the secondary explosive compound 101 as shown and described in FIG. 3. Likewise, the different closure members 99' of FIG. 5 and 99'' of FIG. 6 could be substituted for closure members 99 in the embodiments of FIGS. 3 and 4. Likewise, the jackets 97 of the embodiments of the second element 89 shown and described in FIGS. 3 and 4 could be filled entirely with the primary explosive compound, or lead azide, 102 as shown in FIGS. 5 and 6.

In another embodiment of the explosive safe-arming system 70 of the present invention, the closure members 99, 99' and 99'', of FIGS. 3–6, or portions thereof, could be deleted, whereby the lower end 98 of the second element 89 is not completely sealed and is provided with a means for desensitization of the second element 89. In this embodiment, the flame actuated explosive compound, or match compound, 103 in the embodiment of FIG. 3 and the primary explosive compound 102 in the embodiments of FIGS. 4–6, will be wetted, or desensitized, by any undesired fluid which could happen to enter carrier 72 and form a fluid barrier in gap 96 between the first element 88 and the second element 89 of the donor detonating explosive 87. Upon the wetting, or desensitization, of the explosive compound, 102 or 103, detonation of the second element 89 of the donor detonating explosive will be prevented.

It should be pointed out that a perforating gun 71 provided with the explosive safe-arming system 70 of the present invention can be completely manufactured and assembled in a field or factory environment, but for the insertion of the second element 89 of the donor detonating explosive 87, including: the provision of all suitable wiring, such as 93; fixedly securing the first element 88 of the donor detonating explosive 87 in carrier 72; and fixedly securing the booster 80 and detonating cord 78 within carrier 72 of perforating gun 71. With the second element 89 of the donor detonating explosive 87 removed from perforating gun 71, the lower end 94 of booster 80 is in a spaced relationship from the first element 88 of the donor detonating explosive 87 as previously described. Were the first encased element 88 of the donor detonating explosive to be accidentally ignited and detonated, the ignition of the first element 88 would not produce an explosive force sufficient to detonate the secondary explosive material 86 in booster 80.

Since the secondary explosive compound 86 of booster 80 is a secondary explosive compound, which is relatively stable and requires an explosive force for detonation, the completely assembled perforating gun 71 can be conveniently and safely transported to the desired well bore in the field. Upon arrival of the perforating gun 71 at the desired well bore, no complicated procedures are necessary to arm the perforating gun 71, but rather all that is required is to mount the second element 89 of the donor detonating explosive 87 through access port 77 into an operative relationship with the first encased element 88 and the receptor detonating explosive, or booster, 80. Thus, no last minute electrical connections or other detailed preparations are required to ready the perforator 71 for firing, which is especially advantageous when such electrical connections or other detailed preparation must be made under severe environmental conditions. Although extreme care must be exercised in handling and shipment of the second encased element 89 of the donor detonating explosive 87, the smaller size of the second element 89, in comparison to the completely assembled perforator 71, minimizes transportation and handling problems.

The foregoing description of the invention has been directed in primary part to a particular preferred embodiment in accordance with the requirements of the Patent Statutes and for purposes of explanation and illustration. It will be apparent, however, to those skilled in this art that many modifications and changes in this specific apparatus may be made without departing from the scope and spirit of the invention. For example, other structures could be utilized for securing the donor and receptor detonating explosives, as well as other types of closure members for the second element of the donor detonating explosive.

It is applicant's intention in the following claims to cover such modifications and variations as fall within the true spirit and scope of the invention.

I claim:

1. In a well bore perforator having an enclosed carrier with an access port therein and explosive means in said carrier, including at least one shaped explosive charge, a receptor detonating explosive cooperatively arranged and adapted for detonating said shaped explosive charge, and a donor detonating explosive adapted for detonating said receptor explosive, the improvement which comprises:

an explosive safe-arming system wherein said donor detonating explosive includes two encased elements, the first element being fixedly secured within the carrier, and the second element being removably mounted within the carrier and adapted to be inserted into the carrier through the access port into an operative relationship with the first element and the receptor detonating explosive.

2. The improvement of claim 1 which includes magnetic retention means for removably mounting the second element within the carrier.

3. The improvement of claim 1 wherein the second element of the explosive safe-arming system contains only a primary explosive compound.

4. The improvement of claim 1 wherein the second element of the explosive safe-arming system contains a primary explosive compound and a secondary explosive compound.

5. The improvement of claim 1 wherein the first element of the explosive safe-arming system contains a flame producing compound and the second element contains a flame actuated explosive compound.

6. The improvement of claim 5 wherein the second element of the explosive safe-arming system has one of its ends closed by an insertable plug member having a pyrotechnic fuse wire disposed therein, whereby the fuse wire is in a flame transmitting relationship between the flame producing compound in the first element of the explosive safe-arming system and the flame actuated compound in the second element of the explosive safe-arming system.

7. The improvement of claim 5 wherein the second element of the explosive safe-arming system is removably mounted within the carrier in a spaced relationship from the first element of the explosive safe-arming system, whereby upon entrance of fluid into the carrier, a fluid barrier is formed between said first and second elements and the flame produced by the first element of the safe-arming system will not be transmitted through the fluid barrier to the second element of the explosive safe-arming system.

8. The improvement of claim 5 wherein the second element of the explosive safe-arming system has an end in operative relationship with the first element of the explosive safe-arming system and said end is not completely sealed, whereby upon entrance of fluid into the carrier, the flame actuated explosive compound of the second element will be desensitized by the fluid and can not be detonated.

9. An explosive safe-arming system, for use with a well bore perforator having an enclosed carrier with an access port and a receptor detonating explosive, therein, comprising:

a donor detonating explosive including two encased elements;

the first element being fixedly secured within the carrier; and the second element being removably mounted within the carrier and adapted to be inserted into the carrier through the access port into an operative relationship with the first element and the receptor detonating explosive.

10. The explosive safe-arming system of claim 9 which includes magnetic retention means for removably mounting the second element within the carrier.

11. The explosive safe-arming system of claim 9 wherein the second element of the explosive safe arming system contains only a primary explosive compound.

12. The explosive safe-arming system of claim 9 wherein the second element of the explosive safe-arming system contains a primary explosive compound and a secondary explosive compound.

13. The explosive safe-arming system of claim 9 wherein the first element of the explosive safe-arming system contains a flame producing compound and the second element contains a flame actuated explosive compound.

14. The explosive safe-arming system of claim 13 wherein the second element of the explosive safe-arming system has one of its ends closed by an insertable plug member having a pyrotechnic fuse wire disposed therein, whereby the fuse wire is in a flame transmitting relationship between the flame producing compound in the first element in the explosive safe-arming system and the flame actuated compound in the second element of the explosive safe-arming system.

15. The explosive safe-arming system of claim 13 wherein the second element of the explosive safe-arming system is removably mounted within the carrier in a spaced relationship from the first element of the explosive safe-arming system, whereby upon entrance of fluid into the carrier, a fluid barrier is formed between said first and second elements, and the flame produced by the first element of the safe-arming system will not be transmitted through the fluid barrier to the second element of the explosive safe-arming system.

16. The explosive safe-arming system of claim 13 wherein the second element of the explosive safe-arming system has an end in operative relationship with the first element of the explosive safe-arming system and said end is not completely sealed, whereby upon entrance of fluid into the carrier, the flame actuated explosive compound of the second element will be desensitized by the fluid and cannot be detonated.

* * * * *